US005960491A

United States Patent [19]

Olender

[11] Patent Number: 5,960,491

[45] Date of Patent: Oct. 5, 1999

[54] FUTON COUCH/BED FRAME

[76] Inventor: Richard D. Olender, 6416 Scheel Dr., Woodbury, Minn. 55125

[21] Appl. No.: 09/046,877

[22] Filed: Mar. 24, 1998

[51] Int. Cl.[6] ..... A47C 17/17; A47C 17/04

[52] U.S. Cl. ..... 5/37.1; 5/47

[58] Field of Search ..... 5/37.1, 47, 38, 5/39, 48

[56] References Cited

U.S. PATENT DOCUMENTS

| | | | |
|---|---|---|---|
| 1,064,306 | 6/1913 | Fisher | 5/47 |
| 4,217,669 | 8/1980 | Fefferman | 5/47 |
| 4,829,611 | 5/1989 | Fireman et al. | 5/47 |
| 5,129,114 | 7/1992 | Withers | 5/47 |
| 5,153,951 | 10/1992 | Hester | 5/37.1 |
| 5,170,519 | 12/1992 | Meade | 5/37.1 |
| 5,303,432 | 4/1994 | Fitts | 5/37.1 |
| 5,327,591 | 7/1994 | Fireman et al. | 5/47 |
| 5,429,415 | 7/1995 | Meade | 5/38 |
| 5,485,638 | 1/1996 | Newton | 5/37.1 |
| 5,513,398 | 5/1996 | Dodge | 5/37.1 |
| 5,519,902 | 5/1996 | Meade | 5/38 |
| 5,628,076 | 5/1997 | Newton | 5/37.1 |
| 5,664,268 | 9/1997 | Stoler et al. | 5/37.1 |

*Primary Examiner*—Alexander Grosz
*Attorney, Agent, or Firm*—Nikolai, Mersereau & Dietz, P.A.

[57] ABSTRACT

A futon couch/bed frame is constructed for ease of shipping, assembly and use. It comprises a base with first and second tubular end members joined together in parallel, spaced-apart relation by front and rear rails which frictionally join to the end members without the use of screw fasteners. Pivotally supported on the base are first and second seat members that hinge together this seat assembly attaches to the base using only two bolts that pivotally join the seat assembly to the spaced-apart tubular end portions.

9 Claims, 3 Drawing Sheets

FUTON COUCH/BED FRAME

BACKGROUND OF THE INVENTION

I. Field of the Invention

This invention relates generally to an item of furniture, and more particularly to a frame for a futon couch/bed.

II. Discussion of the Prior Art

Arrangements for tilting a sofa bed between a bed position and a couch position are quite well known in the art. In bi-fold arrangements, there is provided a frame having two sections that are pivotally movable with respect to one another between a "couch" position, in which the sections are disposed at an angle to one another so as to form a seat and back rest combination, and a "bed" disposition where the two sections become coplanar and form a futon supporting surface. The couch/bed futon supporting sections are typically mounted on a base member so that the couch/bed futon supporting sections will be elevated relative to the floor. Typical of prior art futon couch/bed frames are described in the following United States patents:

| | |
|---|---|
| Newton | 5,485,638 |
| Dodge | 5,513,398 |
| Stoler et al. | 5,664,268 |
| Meade | 5,429,415 |
| Fitts | 5,303,432 |
| Meade | 5,170,519 |
| Withers | 5,129,114 |

A common shortfall of the prior art futon couch/bed frames is that they typically incorporated somewhat complicated linkages for coupling the futon support segments to the base making the unit difficult to assemble and generally requiring two persons to accomplish such assembly. Moreover, the base and futon support segments in prior art futon couch/bed arrangements tend to be quite bulky when disassembled making packaging and shipping of the parts in disassembled form relatively difficult and expensive.

A need, therefore, exists for a futon couch/bed combination that has a minimum of parts and which can fit into a relatively flat carton during shipment and which can be readily assembled by a single person in only a manner of minutes. The present invention meets that need.

SUMMARY OF THE INVENTION

The futon couch/bed constructed in accordance with the present invention includes a base that includes a pair of generally U-shaped tubular members, each defining first and second spaced-apart legs that are adapted to rest on a floor surface and with a cross-bar affixed to and extending between the first and second legs on each of the pair of U-shaped tubular members. The U-shaped tubular members comprise the ends of the couch/bed and extending between them are front and rear rails that define the width dimension of the couch/bed. The front rail is affixed to and extends between the first legs of the pair of tubular members while the rear rail is affixed to and extends between the second legs of the pair of tubular members.

A first, generally rectangular, seat member is pivotally supported along a first axis between the aforementioned cross-bars of the base. A second generally rectangular seat member is adapted to be pivotally hinged to the first seat member along a second axis that is parallel to and offset from the first axis. Because of this offset, when the two rectangular seat members are configured as a futon couch, the first seat member becomes the couch back and the second seat member becomes the seat surface on which one or more persons may situate themselves. The seat back is inclined at a predetermined angle to the vertical and the seat surface is inclined at predetermined angles to the horizontal to enhance comfort. The couch configuration is held rigid by the engagement of a locking channel welded to the underside of the second seat member with the front rail. To convert the unit from a couch to a bed merely requires one to easily lift the second seat member to disengage the locking channel from the front rail and then allow the first and second seat members to become coplanar as they respectively rest on the front and rear rails.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
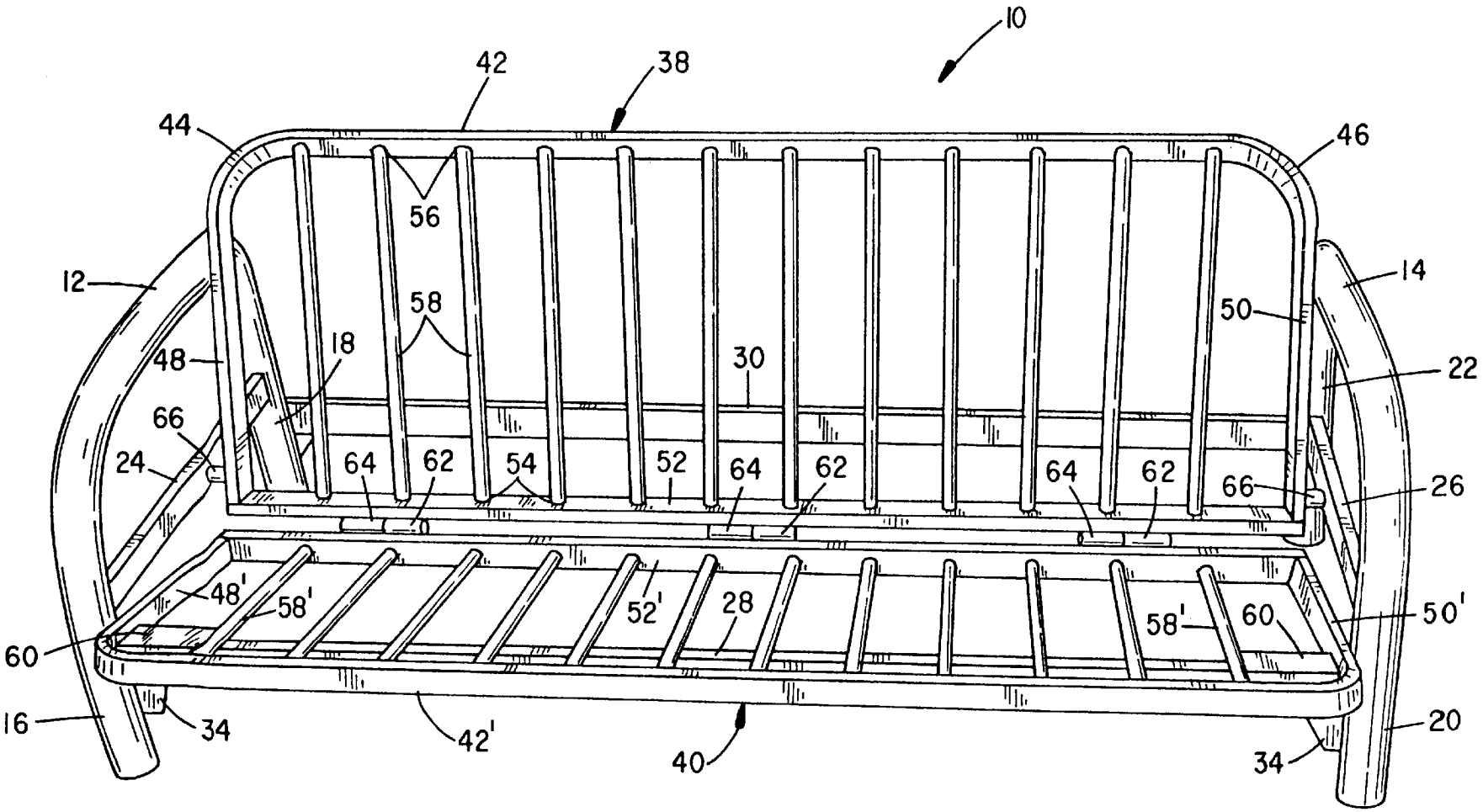
FIG. 1 is a front perspective view of the futon bed/couch frame when configured as a couch.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

The present invention is for a futon frame which, in combination with a futon-style mattress (not shown), will serve as a couch when in a first position and as a bed when in a second position. The frame is indicated generally by numeral 10 and is seen to comprise a base having left and right end pieces 12 and 14, respectively. Each of the end pieces comprises a generally U-shaped member, preferably formed from tubing of circular cross-section, and which is appropriately bent to define a pair of spaced-apart legs 16 and 18 on the left end piece 12 and 20 and 22 on the right end piece 14. Extending between and connected to the legs 16 and 18 is a cross-bar 24 and, likewise, a similar cross-bar 26 extends between and is affixed to the legs 20 and 22 of the right end member 14.

Figure 3:
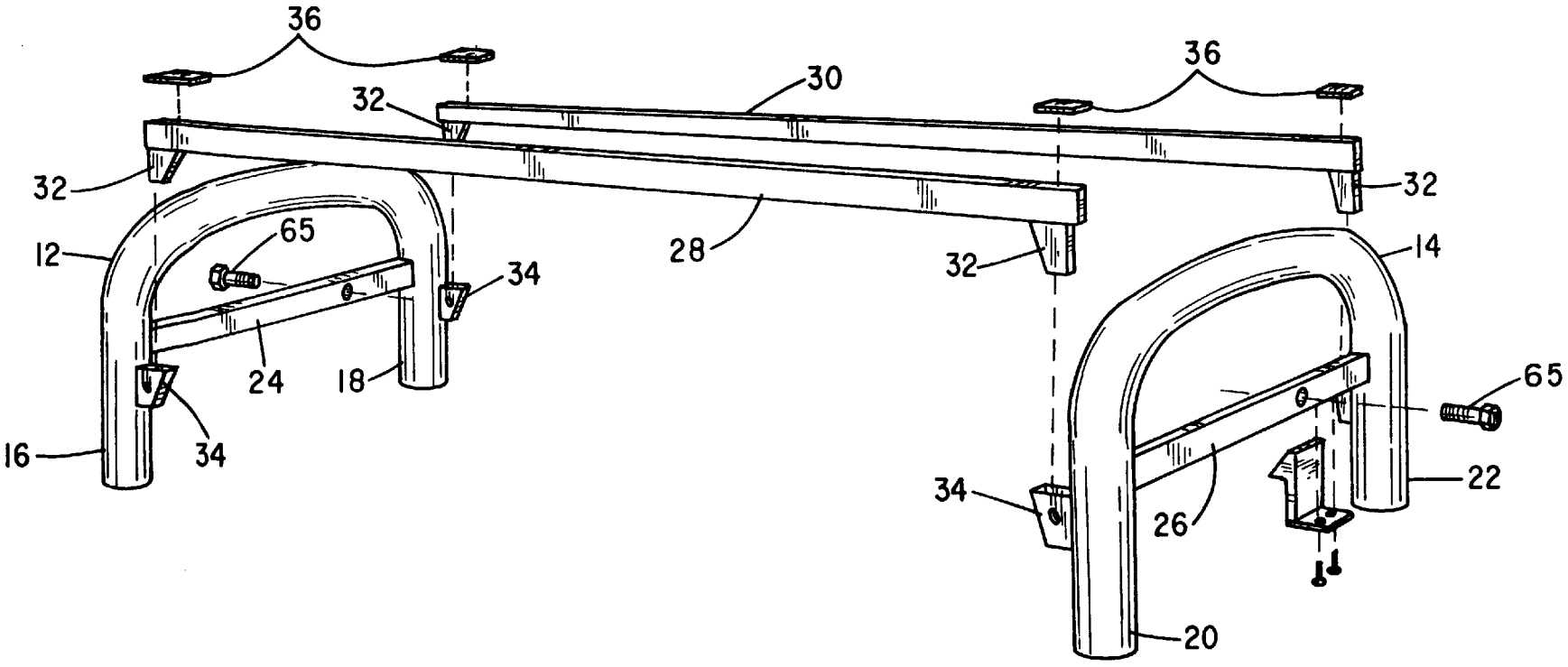
FIG. 3 is an exploded perspective view of the base assembly for the futon couch/bed frame.

Referring momentarily to FIG. 3, the base for the futon couch/bed not only comprises the first and second end members 12 and 14, but also an elongated front rail member 28 and a corresponding rear rail member 30. The front and rear rails establish the length of the couch and the width of the bed. Welded or otherwise affixed to the rails 28 and 30 at each end thereof are tapered lugs 32 that are designed to fit into correspondingly shaped tapered sockets 34 that are welded to the legs 16 and 18 of the U-shaped end member 12 and legs 20 and 22 of the U-shaped end member 14. By inserting the lugs 32 into their respective sockets 34, the end members 12 and 14 will be maintained in parallel, spaced-apart relationship with respect to one another. Rubber pads, as at 36, are adhesively attached to the upper edge surface of the rails 28 and 30 at each end thereof and, as will be further explained, act as a cushion between the rails 28, 30 and the seat members of the futon couch/bed frame.

Figures 2, 2A:
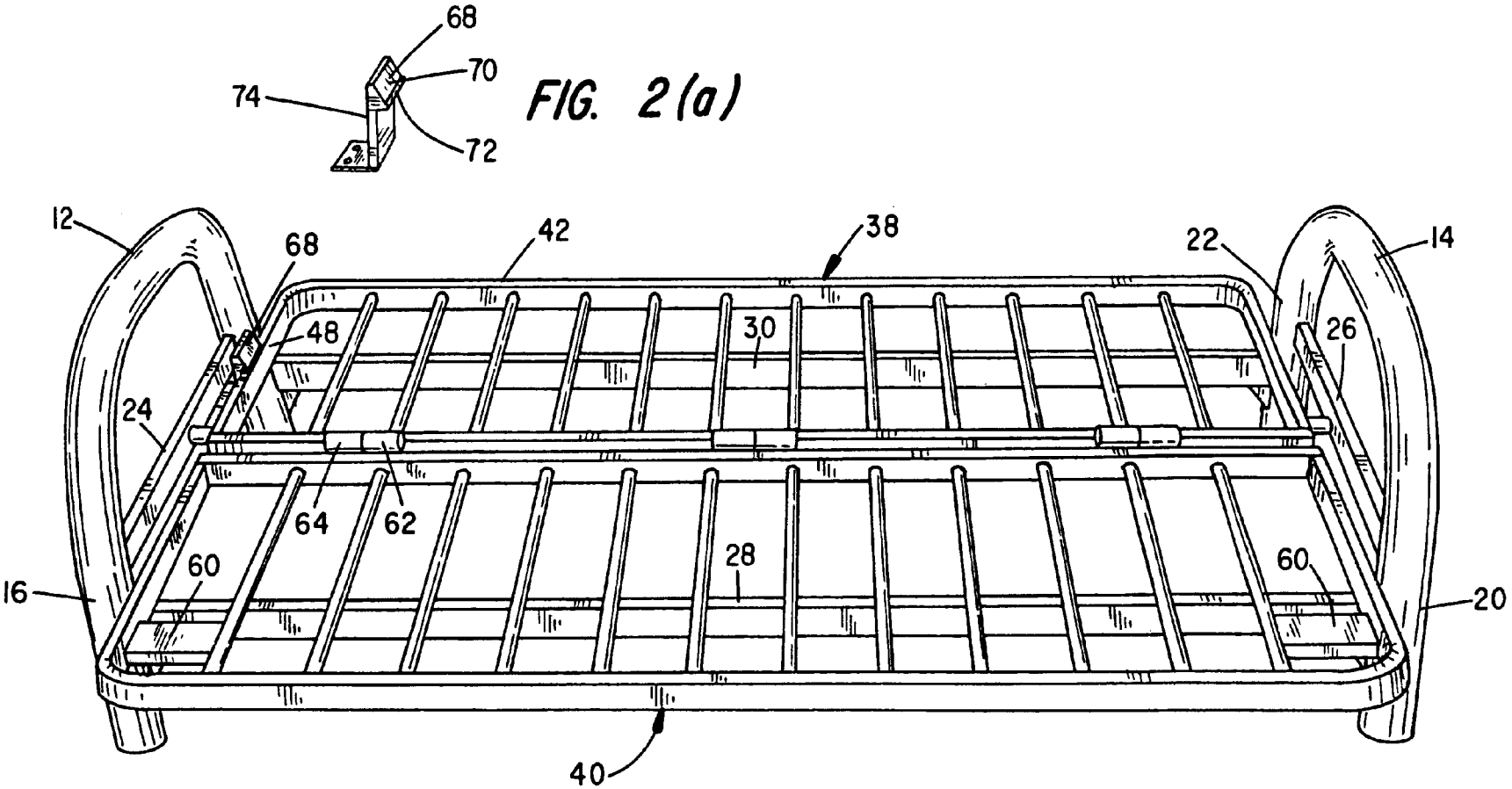
FIG. 2 is a front perspective view of the futon couch/bed frame when configured as a bed.

Referring now to FIGS. 1 and 2, the futon mattress supporting assembly comprises a first, generally rectangular seat member indicated generally by numeral 38 and a second generally rectangular seat member identified generally by numeral 40. Seat members 38 and 40 have approximately the same length and width dimension and each comprises an elongated tube of rectangular cross-section 42 that is bent along a 90° arc at 44 and 46 to define parallel side segments 48 and 50. Extending between and welded to the free ends of the side segments 48 and 50 is a cross-member 52. The tubular bar 42, its end segments 48 and 50 along with the tubular rail 52 define an open, generally rectangular frame. Formed partially through the tubular rail members 42 and 52 are a plurality of bores as at 54 and 56 and fitted into each of the bores 54 and 56 so as to span the open central portion of the frame are a plurality of rib members, as at 58. The opposed ends of the ribs 58 are also preferably welded to the frame members 52 and 42.

In that the second seat member 40 is constructed substantially identically to the first seat member 38, it is felt unnecessary to describe the constructional features of the latter, save to say that on the second seat member 40 there is welded between the end portion 48' thereof and the rib 58' adjacent to it a short length of U-shaped channel 60 that is dimensioned to span and fit over the front rail 28 when the futon couch/bed is configured as a couch as shown in FIG. 1. The engagement of the channel segments 60 with the front rail 28 serves to lock the seat members relative to the base.

As can be seen in the views of FIGS. 1 and 2, the first seat member 38 has male hinge members 62 welded to the outer surface of the rail 52. Likewise, the second seat member 40 has female hinge elements 64 welded to the outer surface of the rail 52'. Hence, the seat members 38 and 40 are able to pivot relative to one another along an axis that extends through each of the hinges.

Only two bolts are required to assemble the hinged-together first and second seat members 38 and 40 to the base. More specifically, a bore is drilled through the cross-arms 24 and 26 and a nut therefore is welded to the end segments 48 and 50 of the first seat member 38. By passing a pair of bolts as at 65 (FIG. 3) through the aforementioned bore and through tubular spacers 66 and into the nuts (not shown), the first seat member 38 becomes pivotally suspended to the base along an axis that is parallel to and offset from the axis of the hinges 62–64.

To convert the unit from the couch configuration shown in FIG. 1 to the bed configuration shown in FIG. 2, a person need only lift the rail 42' slightly until the channels 60 welded to underside of the second seat member clear and no longer engage the front rail 28. Now, by pulling on the front rail 42', the first seat member 38 will begin to pivot about the bolts securing it to the cross-arms 24 and 26 of the base while the first and second seat members 38 and 40 also pivot about the hinges 62–64. Thus, the first seat member 38 that had comprised the seat back when in the couch configuration drops down so as to rest upon the rear rail 30 while the second seat member 40 rests upon the front rail 28 in a coplanar relation. At this point, the inverted channels 60 are disposed forward of the front rail 28 and no longer encompass it.

To prevent the first and second seat members 38 and 40 from pivoting about the hinges 62–64 as the weight of a person is applied to the bed, there is affixed to the cross-arm 24 a leaf spring latch 68 having a sloping front surface 70 terminating in an abrupt edge 72. As the first seat member 38 is lowered from the couch disposition to the bed disposition, its end portion 48 engages the sloped surface 70 causing the latch 68 to deflect against the force of the leaf spring 74. When the upper edge of the end member 48 clears the edge 72 of the latch, it will snap forward to engage the end segment 48 of the rail 42 precluding any upward rotation of the first seat member 38 about hinges 62–64.

In reconverting the futon couch/bed frame to its couch disposition, a person need only manually deflect the latch 68 until its edge 72 clears the end portion 48 of the first seat member 38, allowing it to be lifted to the point where the channels 60 abut the front surface of the front rail 28. At this point, the user lifts the second seat member 40 slightly until the channels 60 are disposed directly above the front rail 28, at which point, the second seat member 40 is lowered, with the channel 60 now straddling the rail 28 to lock the seat segments 38 and 40 against any further rotation about the axis extending through the suspension bolts 65 pivotally suspending the seat assembly to the base.

The futon frame of the present invention will typically be shipped in a carton with the base disassembled and with the first and second seat members 38 and 40 uncoupled from one another, i.e., unhinged. To assemble the unit, the owner need only insert the lugs 32 on the front and rear rails into the sockets 34 welded to the U-shaped tubular members 12 and 14 and tap them in place with a hammer. Next, by placing the first and second seat members 38 and 40 on end and aligning the male hinge members 62 with the female hinge members 64, the two seat halves become pivotally joined. A first bolt 65 is then passed through the bore formed through the cross-arms 24 and 26 and through a tubular spacer 66 before it is advanced into the nuts (not shown) that are welded into the end segments 48 and 50 of the first seat member 38. These assembly operations can be accomplished in a manner of only a few minutes. It is apparent that disassembly for later storage of the futon is equally easy.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A futon couch/bed, comprising:

(a) a base including (i) a pair of generally U-shaped tubular members, each defining first and second spaced-apart legs adapted to rest on a floor surface with a cross-bar affixed to and extending between said legs on each of said pair of tubular members;

(ii) a front rail affixed to and extending between the first legs of the pair of tubular members; and (iii) a rear rail affixed to and extending between the second legs of the pair of tubular members, said front and rear rails maintaining the U-shaped tubular members in parallel, spaced-apart relation;

(b) a first generally rectangular seat member pivotally supported along a first axis between the cross-bars of said base;

(c) a second generally rectangular seat member pivotally hinged to the first seat member along a second axis that is parallel to and off-set from the first axis; and (d) a releasible latch for securing the first seat member to the cross-bar of one of said U-shaped tubular members when the first and second seat members are pivoted to a generally coplanar relationship when the futon couch/bed is configured as a bed.

2. The futon couch/bed as in claim 1 wherein the first and second seat members each comprise a generally rectangular frame having first and second longitudinal rails with transversely extending end rails defining a central opening and having a plurality of regularly spaced ribs extending between the first and second longitudinal rails in the central opening.

3. The futon couch/bed as in claim 2 and further including means affixed to the second seat member and adapted to engage the front rail of the base when the futon couch/bed is configured as a couch.

4. The futon couch/bed as in claim 3 wherein the means affixed to the second seat member comprises a pair of rail engaging members adapted to engage the front rail.

5. The futon couch/bed as in claim 1 wherein the releasible latch comprises a spring member having a first end thereof cooperating with said cross-bar of said one of said U-shaped tubular members and urging a latch member into engagement with one of the end rail of the first seat member.

6. The futon couch/bed as in claim 1 wherein the first seat member is pivotally supported between the cross-bars of the base by a pair of bolts.

7. The futon couch/bed as in claim 6 and further including tubular spacers surrounding each of the pair of bolts and extending between the cross-bars and the first seat member.

8. The futon couch/bed as in claim 1 wherein the front and rear rails are removably affixed to the first and second legs on each of the tubular members, respectively.

9. A futon couch/bed, comprising:

(a) a base including (i) a pair of generally U-shaped tubular members, each defining first and second spaced-apart legs adapted to rest on a floor surface with a cross-bar affixed to and extending between said legs on each of said pair of tubular members;

(ii) a front rail removably affixed to and extending between the first legs of the pair of tubular members; and (iii) a rear rail removably affixed to and extending between the second legs of the pair of tubular members, said front and rear rails maintaining the U-shaped tubular members in parallel, spaced-apart relation;

(b) a first generally rectangular seat member pivotally supported by a pair of bolts having tubular spacers thereon along a first axis between the cross-bars of said base;

(c) a second generally rectangular seat member pivotally hinged to the first seat member along a second axis that is parallel to and off-set from the first axis and with a pair of rail engaging members adapted to engage one of the front rail and rear rail; and (d) a releasible latch for securing the first seat member to the cross-bar of one of said U-shaped tubular members when the first and second seat members are pivoted to a generally coplanar relationship when the futon couch/bed is configured as a bed.

* * * * *